United States Patent [19]

Galletti et al.

[11] Patent Number: 4,794,776

[45] Date of Patent: Jan. 3, 1989

[54] LOAD-BEARING STRUCTURE FOR A CONTINUOUS ROLLING MILL FOR SEAMLESS TUBE MAKING

[75] Inventors: Cesare Galletti, San Felice di Segrate; Emanuele Gancia, Milan; Giorgio Quecchia, Corsico, all of Italy

[73] Assignee: INNSE Innocenti Santeustacchio S.p.A., Brescia, Italy

[21] Appl. No.: 10,823

[22] Filed: Feb. 4, 1987

[30] Foreign Application Priority Data

Feb. 6, 1986 [IT] Italy ..... 19310 A/86

[51] Int. Cl.[4] ..... B21B 17/04; B21B 31/08

[52] U.S. Cl. ..... 72/235; 72/209; 72/238

[58] Field of Search ..... 72/235, 237, 238, 208, 72/209

[56] References Cited

U.S. PATENT DOCUMENTS

| | | | |
|---|---|---|---|
| 2,101,959 | 12/1937 | Schulz | 72/235 X |
| 2,264,688 | 12/1941 | Wolf | 72/235 X |
| 3,016,772 | 1/1962 | Hornbostel | 72/235 X |
| 4,038,855 | 8/1977 | Scheib | 72/235 X |

*Primary Examiner*—Robert L. Spruill
*Assistant Examiner*—Steven B. Katz
*Attorney, Agent, or Firm*—Birch, Stewart, Kolasch & Birch

[57] ABSTRACT

A continuous rolling mill for producing seamless tubes, operating on the restrained mandrel principle, has a stand-less structure which includes a load-bearing box-type framework wherein there are formed seats for accommodating working rolls and their chocks. The structure has reduced bulk in the axial direction and weight.

5 Claims, 6 Drawing Sheets

LOAD-BEARING STRUCTURE FOR A CONTINUOUS ROLLING MILL FOR SEAMLESS TUBE MAKING

BACKGROUND OF THE INVENTION

1. Field of the Invention

This invention relates to a load-bearing structure for a continuous rolling mill for seamless tube making from axially bored blanks fitted over respective mandrels.

More specifically, this invention relates to a load-bearing structure for a continuous rolling mill, operating on the so-called restrained mandrel technique, and of a type which comprises a plurality of pairs of working rolls and related chocks and aligned at an alternate angle to the rolling axis.

With continuous rolling mills of the above-specified type, as utilized heretofore, the working roll pairs and respective chocks are supported on corresponding stands attached, in turn, to a load-bearing structure (bed or base of the mill), which is anchored securely to the floor. Usually, the stands and beds are made oversize to effectively withstand the thrust forces set up during the rolling process.

With mills of the type under consideration, special importance is attached to the working roll replacement operation, and the operation involves replacement of a whole stand including the rolls to be changed with another stand, previously set up off the line and mounting new work rolls. It is for this reason that each stand is designed and built as a unit for separate handling, structurally independent of the other stands, so that it can be installed to and removed from the mill separately from the remaining stands. Each stand removably mounted in a special seat formed in the bed or load-bearing structure of the mill by securing devices, the sizing and import of which may be readily appreciated if due consideration is paid to the heavy weight of a rolling stand (on the average, in the range of about 20 to about 50 metric tons) and to the high thrust forces and stresses brought into play by the rolling process. The bed or load-bearing structure of a conventional rolling mill, as referred to herein, in addition to forming a major part thereof, involves the observance of preset interaxial distances between stands, which distances the most up-to-date rolling technologies tend to minimize, if not to eliminate (compact-design rolling mills, shortened length mandrels, and so forth).

It may be appropriate to point out that a roll change in accordance with the above-outlined prior technique involves a whole series of operations which are complicated to perform and time-consuming. In fact, the operations involved in releasing the stands from the bed of the mill, lifting the stands off and away from the mill, must be always preceded by a whole series of other operations disconnecting hydraulic and/or pneumatic line, electrical lines, etc., which operations are then to be gone through again when a new stand is connected in the roll train.

Moreover there is a disadvantage represented by the need to employ hoisting and hauling equipment of considerable size and power, which in addition to being notoriously difficult to operate, impose a large expenditure of energy, running and depreciation costs, which all add to the already substantial cost of manufacture for a stand. In this respect, it should be also considered that a rolling mill of the type in question is required to be rigged with two sets of stands for each gage, and that the consequent increase in cost and space requirements for such rigging have been long recognized in the art.

With later design mills, the rolls and their respective chocks have formed a unit adapted to be fitted into and taken off a respective stand, thereby the roll changing operation has been made much simpler and the need for replacing the stand eliminated. However, even the latter mills require periodical disassembly of the stands from their respective beds especially for maintenance and checking purposes.

Overcoming all of the disadvantages pointed out hereinabove in connection with prior rolling mills constitutes the technical problem that underlies this invention.

SUMMARY OF THE INVENTION

The solution to this technical problem is that of disposing with the rolling stands and using instead a fixed load-bearing structure for the rolling mill which defines appropriate seats adapted to accommodate plural working roll pairs, and of course, can successfully withstand all and any of the thrust forces, loads, and stresses to be generated during a rolling cycle.

Based on this idea, the instant invention provides a structure for a continuous rolling mill for seamless tube making, of the type indicated, comprising:

a substantially box-type, self-supporting framework extending in the same direction as the rolling axis, as well as being stiffened both in said direction and perpendicularly to it;

a plurality of seats accommodating and supporting plural working roll pairs and their respective chocks, being formed transversely in said framework and arranged adjacently to one another in parallel alignment to said axis.

Further features and advantages of the invention will be more clearly apparent from the following detailed description of an exemplary embodiment of a load-bearing structure for a continuous rolling mill, according to the invention, given herein below with reference to the accompanying illustrative and not limitative drawings.

DETAILED DESCRIPTION OF PREFERRED EMBODIMENTS

Figure 1:
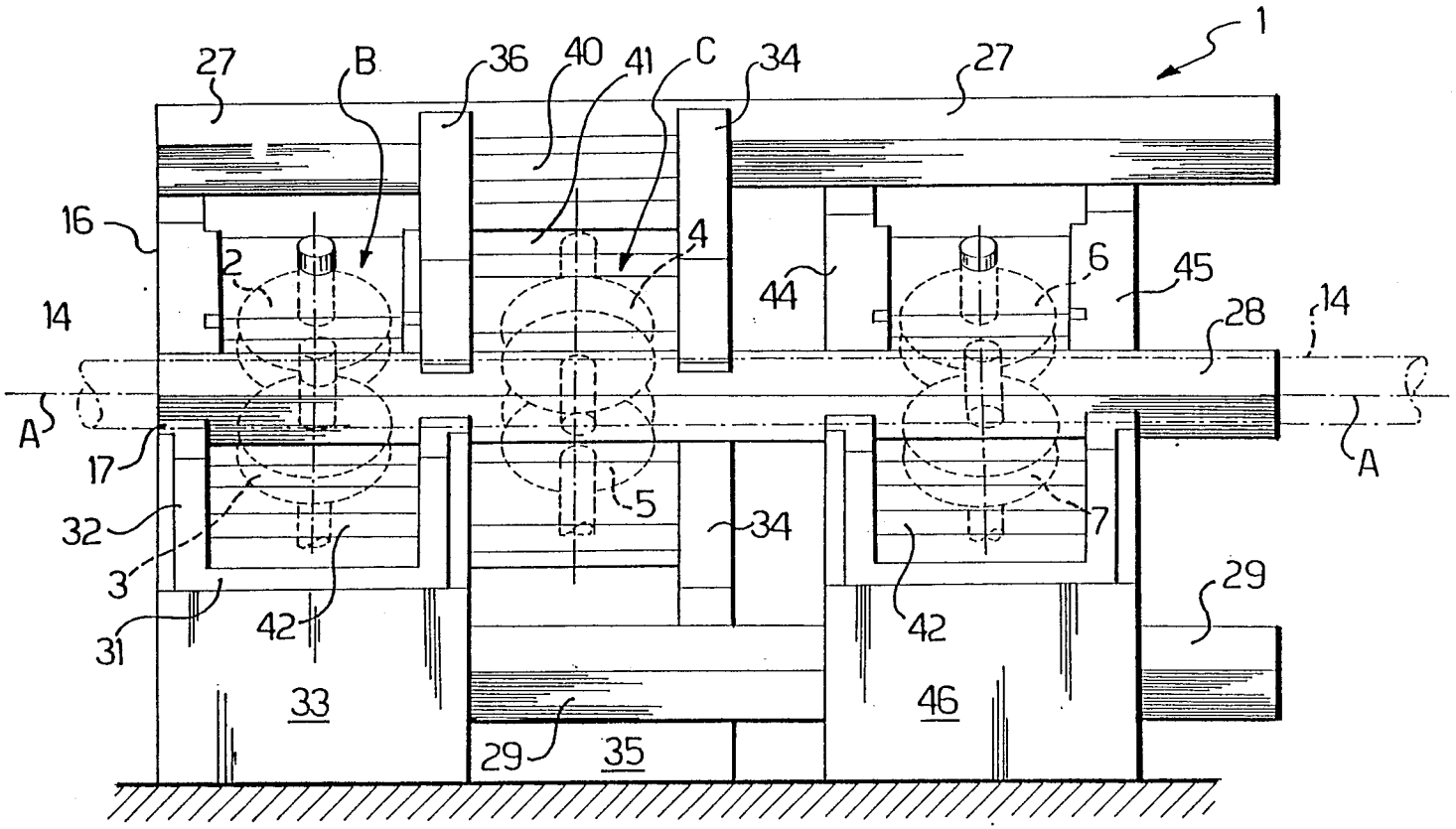
FIG. 1 shows schematically a front view of a load-bearing structure for a continuous rolling mill for seamless tube making, according to the invention.

In the drawing figures, there is shown a load-bearing structure for a continuous rolling mill, according to the invention, which comprises three pairs of working rolls 2-3, 4-5, and 6-7, and their respective chocks 8 to 13, for making a seamless tube from axially bored blanks 14 which are fitted over respective mandrels 15. The continuous rolling mill under consideration operates on the so-called restrained mandrel technique, and the working roll pairs 2 to 7 are aligned and alternately inclined to the rolling axis A (specifically, at an angle of ±45°).

The load-bearing structure 1 is of a substantially box-type framework, generally indicated at 1, which extends in the same direction as the rolling axis A, being secured to the floor and stiffened as explained hereinafter.

On the framework 1, there is supported and secured transversely a first planar subframe 16, preferably having a plate of a set thickness dimension, substantially rectangular in shape, and through-penetrated by an opening 17. This opening 17 has long sides 18 and 19 lying parallel to the long sides 20 and 21 of the plate 16. The long side pairs 18,20 and 19,21 delimit two uprights 23 and 24 in the plate 16. Opening 17 is sized to admit a blank 14 and its related mandrel 15 therethrough, as explained hereinafter.

The plate 16 is provided, at its opposed short sides, with integral upper 25 and lower 26 portions, preferably having an isosceles trapezoid sectional profile, which protrude sideways with respect to the long sides 20,21 and have squared seats **27*a*, 28*a*, 29*a* and 30*a* formed on their ends to accommodate longitudinal stringers 27,28,29 and 30** of a box-type construction, to be described hereinafter.

At its lower portion 26, the plate 16 is provided laterally with a foot consisting of a bracket 31 and a gusset-like portion 32 defined by the portion 26 itself and jutting out therefrom. The bracket 31 has a suitable thickness and is suitably stiffened, the bracket defining a 3 lb rest shelf lying at 45° to the long sides 20,21 of the plate 16, and accordingly, to the long sides 18,19 of the opening 17 thereof.

Figure 2:
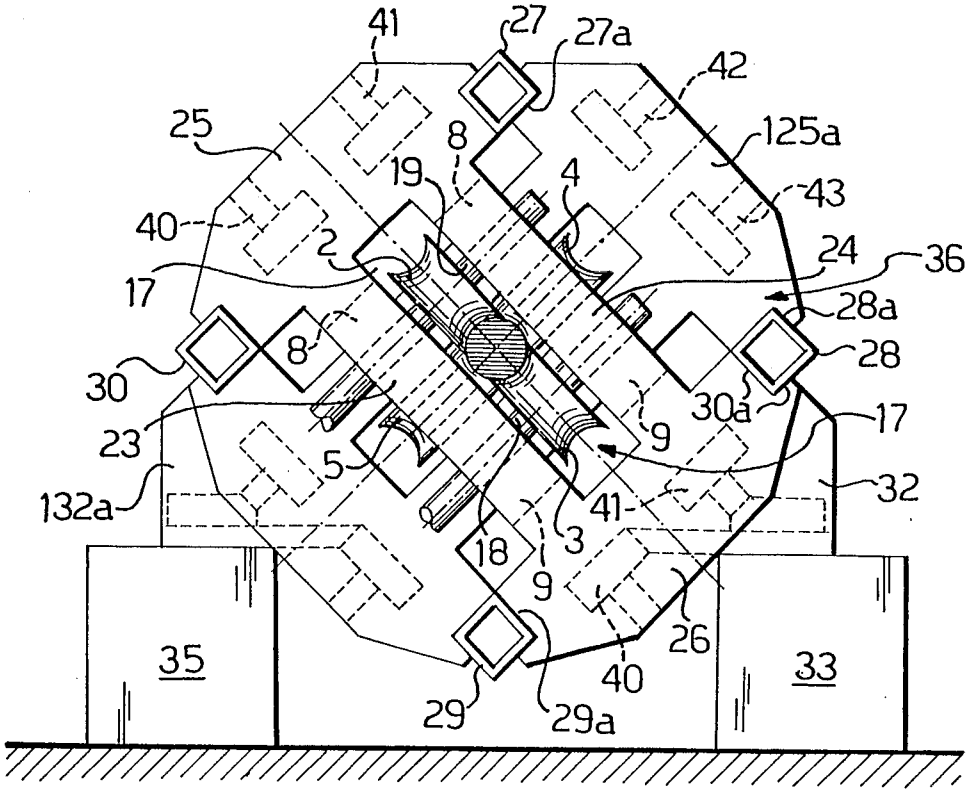
FIG. 2 is a side view of the load-bearing structure shown in FIG. 1.
Figure 3:
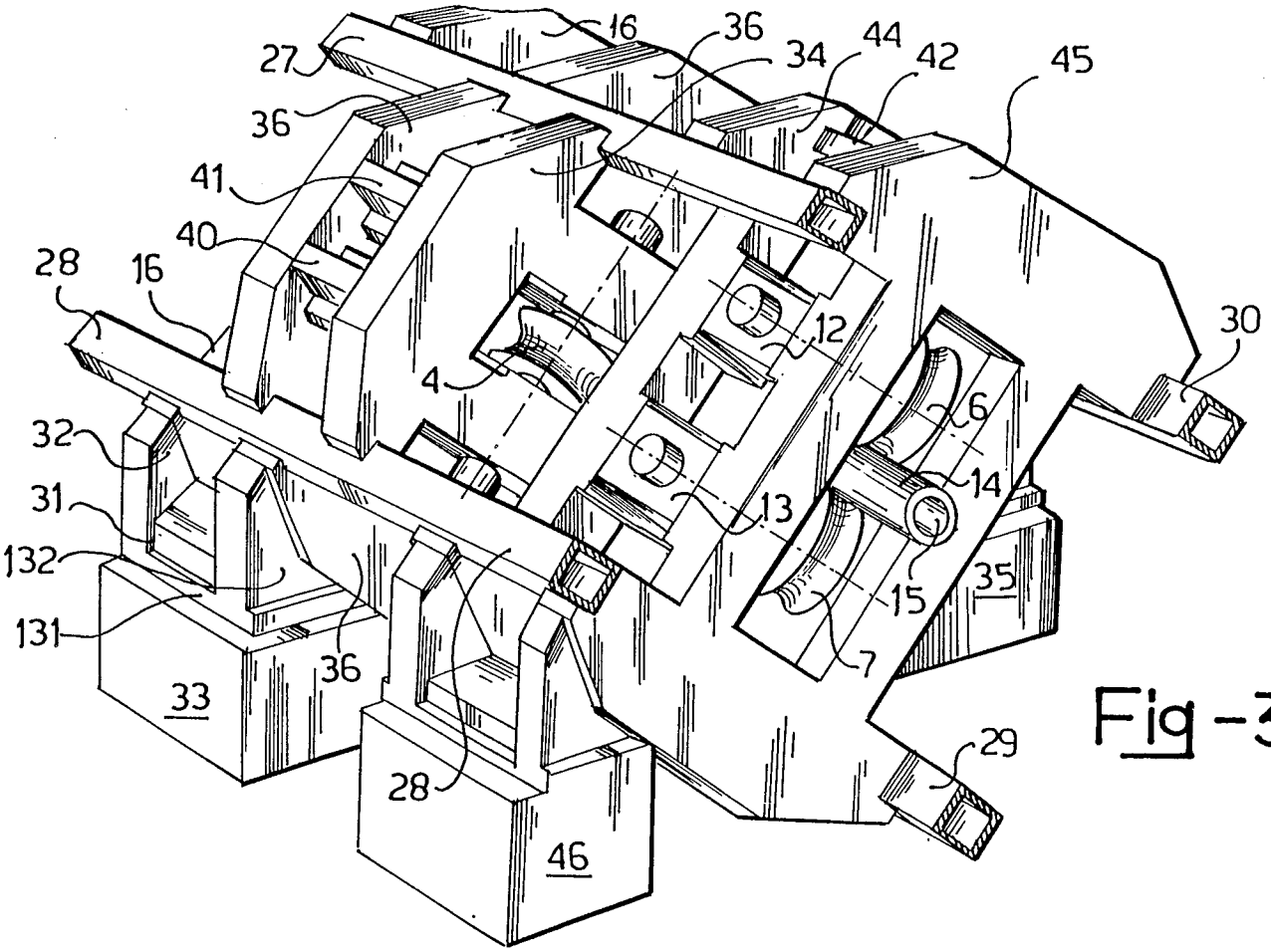
FIG. 3 shows schematically an enlarged scale perspective view of the load-bearing structure of the preceding figures.
Figure 4:
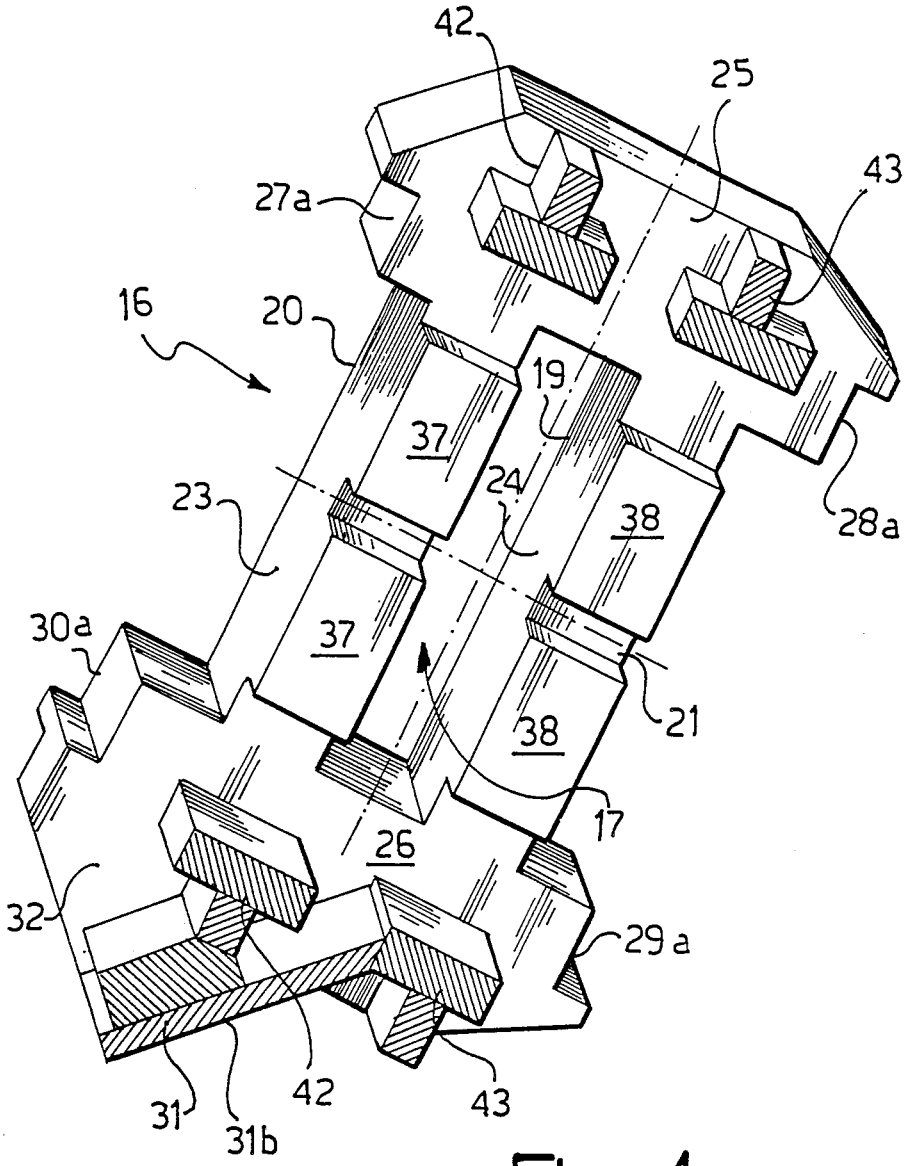
FIG. 4 shows in perspective, and to an enlarged scale, a first component of the load-bearing structure of FIG. 3.

The plate 16 (planar subframe) is fastened through the foot 31-32 by conventional means, not shown, to the horizontal top wall of a foundation plinth 33 (FIG. 2), thereby positioning the plate 16 in a vertical plane perpendicular to the axis A and inclined at 45° from the vertical. The foundation plinth 33 is provided laterally of the rolling axis A at such a distance therefrom that said rolling axis will extend through the center of the opening 17 in the plate 16.

The framework 1 further includes a second planar subframe 34 which also preferably consists of a plate (34) quite similar to the plate 16 described above excepting that its respective foot (bracket **31*a*-gusset 32*a*) rests on a foundation plinth 35 identical to the plinth 33 but located at a symmetrical position on the other side of the rolling axis A. The second plate 34 (or planar subframe) is set at −45° from the vertical, such that the plates 16 and 34** will "cross" each other in mutually perpendicular relationship.

As a consequence, the second plate 34 will not be further described, and in the drawings, its constructional and dimensional features, which are similar to those of the plate 16, will be identified with the same reference numerals carrying an "a" suffix.

Between the planar subframes 16 and 34, within the box-type framework 1, an intermediate planar subframe 36 is carried. The subframe 36 includes preferably, for example, a plate which will be referred to hereinafter the intermediate plate 36.

Figure 5:
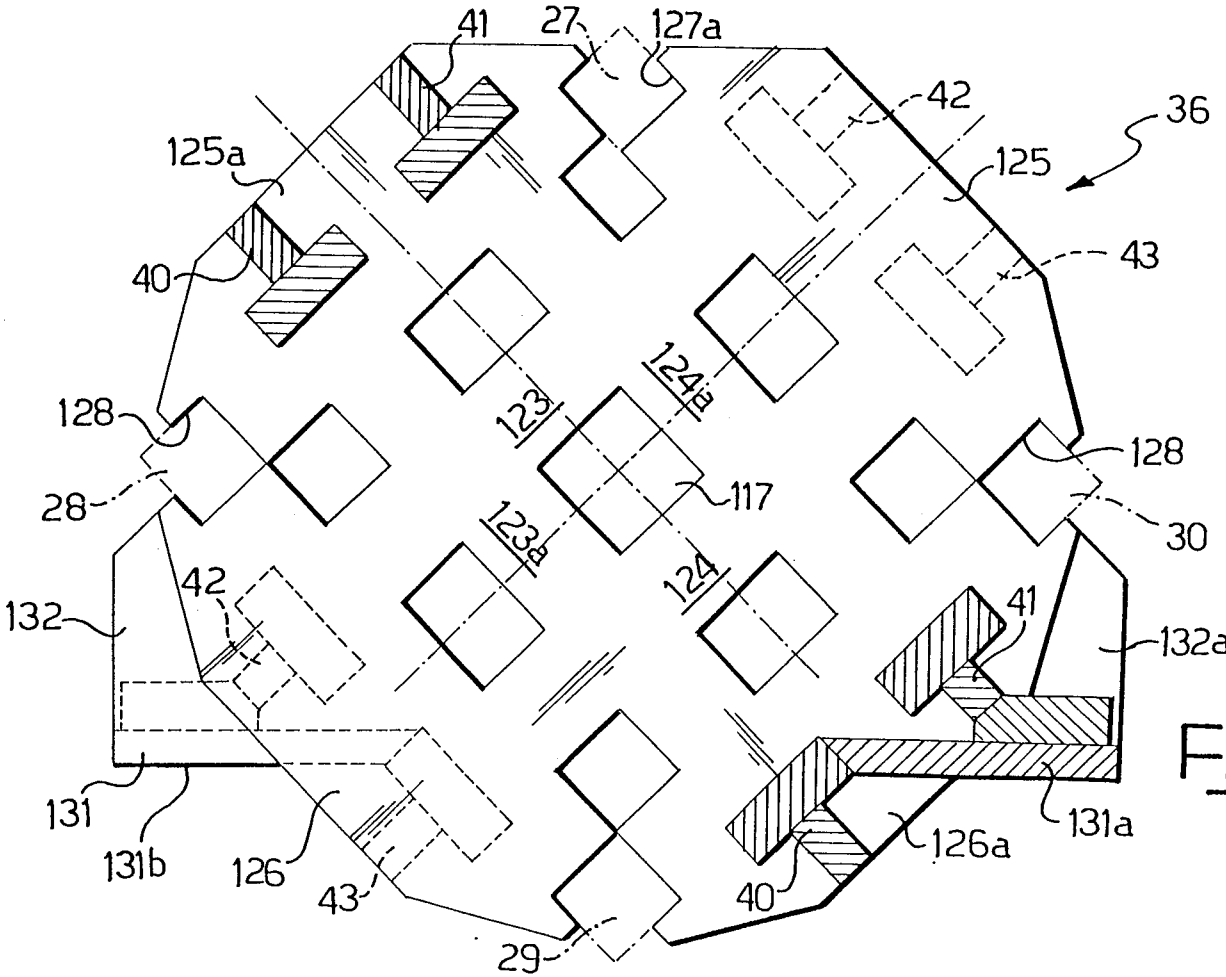
FIG. 5 shows a second component of the load-bearing structure shown in FIG. 3.

The intermediate plate 36 (FIG. 5) has constructional, geometric, dimensional, and shape characteristics which are the outcome of an ideal juxtaposition of the two plates 16 and 34 in the crossed relationship specified above, with the single expedient of keeping continuity of the crossed upright pairs (123,124 and **123*a*,124*a***) unaltered.

Thus, no detailed description of the intermediate plate 36 will be given herein as regards its constructional and geometric features, and in the accompanying drawings, these features, which are quite similar to those of the plates 16 and 34, are identified by like reference numerals increased by 100.

The intermediate plate 36 is provided, at its lower portions 126 and **126*a*, with two feet consisting of brackets 131 and 131*a* set at right angles to respective gussets 132 and 132*a* and receiving support from the previously mentioned plinths 33 and 35. Once it is secured on said foundation plinths, the intermediate plate 36** will be self-supporting.

The plate (planar subframes) 16,36 and 34 stiffen one another into a box-type framework 1 according to the invention by virtue of the box-type longitudinal stringers 27,28,29 and 30 forming an integral and essential part of the mill structure itself, such longitudinal stringers extending parallel to the axis A and being located substantially at the four corners of the subject plates. In this load-bearing structure, the plates 16,36 and 34 are set apart along the axis A and form two seats B and C therebetween for accommodating and supporting pairs of working rolls 2-3 and 4-5 and respective chocks. To accomplish this, (FIG. 6) on the upright 23,24 of the plate 16, on the side thereof next to the intermediate plate 36, there are formed or otherwise mounted flat cheeks 37 and 38 of set thickness.

Like cheeks 137 and 138 are formed, or otherwise mounted, on the uprights 123 and 124 of the intermediate plate 36, on the side thereof next to the plate 16.

Figure 6:
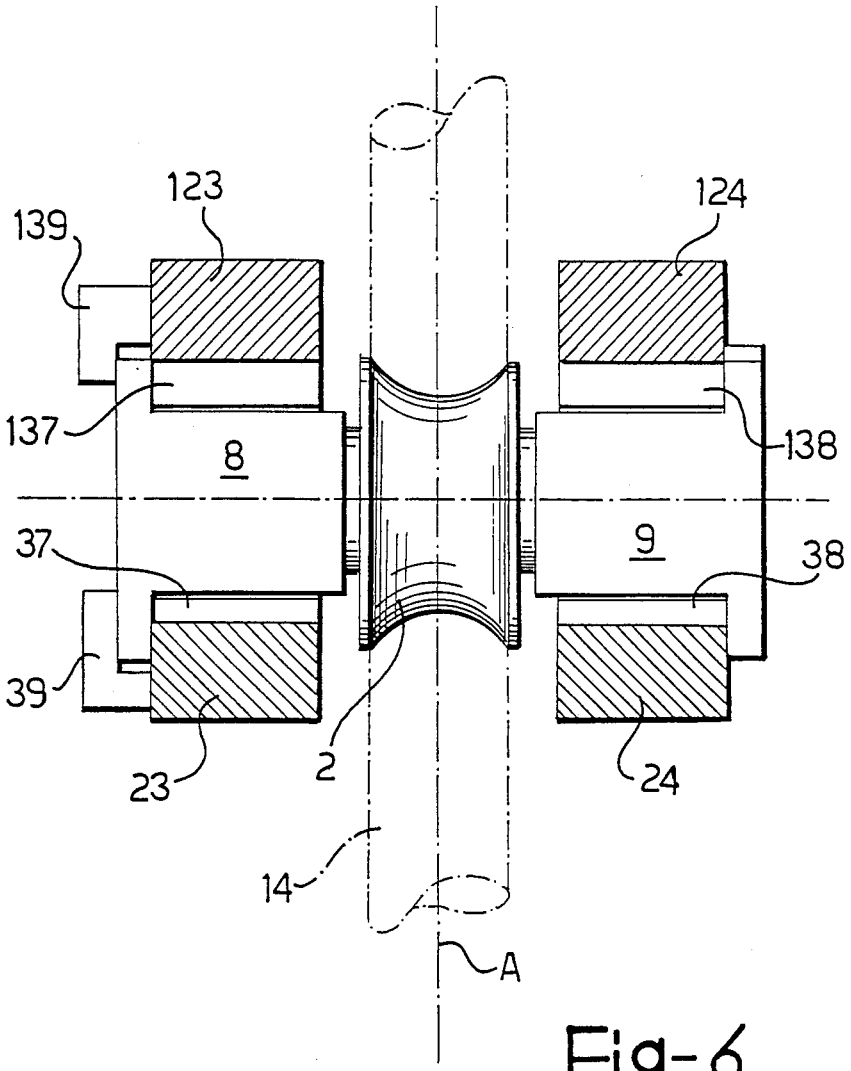
FIG. 6 shows diagrammatically in horizontal section a constructional detail of the inventive load-bearing structure.

Coupled to said cheeks, in a manner known per se, are the chocks 8-9 of the working rolls 2 and 3 which chocks are then removaly secured by clamping means as shown schematically in FIG. 6 at 139 and 140.

In quite a similar manner, on the uprights 123 and 124 of the intermediate plate 36, and on the side thereof facing the second plate 34, there are formed or otherwise mounted flat cheeks, not shown, in the drawings, which cooperate with like cheeks formed or otherwise mounted to the uprights **23*a* and 24*a* of the plate 34, on that side thereof which confronts the intermediate plate 36, to receive the chocks 10-11 of the working roll pair 4 and 5**.

In a conventional way, the above-mentioned chocks are acted upon by either mechanical (screw) or hydraulic means, not shown, to resist the large separating forces which would be applied to the working rolls in the process of rolling a blank fitted over a mandrel.

In order to resist such separating forces, the load-bearing structure of this invention is provided with pairs of beams 40, 41 and 42,43 which extend into the seats B and C and stiffen and connect the plates 16 and 34 to the intermediate plate 36. These beams extend parallel to the rolling axis at a position overlying the uprights of the aforesaid plates, and hence the chocks of the subject working rolls.

The third working roll pair 6-7 and their chocks are supported on another two plates (planar subframes) 44 and 45 in a manner quite similar to that described above in connection with the aforesaid working roll pairs 2-3 and 4-5.

These plates, 44 and 45, are identical to the first plate 16, similarly oriented, and mutually stiffened by two pairs of beams, 40,41 and 42,43. The plates 44 and 45, which are secured to a single foundation plinth 46, are an integral part of the tube rolling mill load-bearing structure herein, and are connected into a unitary construction with the plates 16,36 and 34 by the same box-type longitudinal stringers 27,28,29 and 30.

It should be noted that the plate pair 44 and 45 are in spaced relationship from the plate 34. This to allow insertion therebetween of equipment or a device for supporting and guiding the rolling mandrel, not shown in the drawings because of conventional design.

The advantages afforded by the load-bearing structure for a continuous rolling mill for seamless tube making, according to this invention, are (1) high compacting of the rolling mill in the direction of the rolling axis, with attendant substantial shortening of the interaxial distance between the first and last working roll pairs;

(2) decreased mandrel length, in particular of its moving portion;

(3) shorter productive time of the rolling cycle; and (4) elimination of the rolling stands and their rest and support beds, with attendant considerable in overall weight and bulk.

Within the same basic concept of having a substantially box-type construction, self-supporting framework wherein plural planar walls or subframes, lying vertically perpendicular to the rolling axis, define a corresponding plurality of seats for working roll pairs, several changes and modifications may be introduced which are technically equivalent to the structure disclosed, without departing from the protection scope of the instant invention.

We claim:

1. A continuous rolling mill for producing seamless tubes from axially bored blanks fitted over respective mandrels and operating on a restrained mandrel technique, comprising:

a plurality of working roll pairs and their respective chocks, said plurality of working roll pairs being aligned and alternately inclined at a set angle to a rolling axis;

a substantially box-shape, self-supporting framework extending in the same direction as said rolling axis and being stiffened both in said rolling axis direction and perpendicular thereto;

a plurality of seats for accommodating and supporting said plurality of working roll pairs and respective chocks, said plurality of seats being formed transversely in said framework and arranged adjacent to each other in a parallel alignment with said rolling axis; and a plurality of planar subframes supported and secured transversely on said framework in a mutually spaced relationship along said rolling axis, wherein a number n of said plurality of planar subframes define a number n-1 of said seats for accommodating and supporting working roll pairs;

each said plurality of planar subframes including a plate carried on said framework perpendicular to said rolling axis and being centrally penetrated by an opening of a size to admit a tube blank and its corresponding mandrel through the opening.

2. A continuous rolling mill for producing seamless tubes from axially bored blanks fitted over respective mandrels and operating on a restrained mandrel technique comprising:

a plurality of working roll pairs and their respective chocks, said plurality of working roll pairs being aligned and alternately inclined at a set angle to a rolling axis;

a substantially box-shape, self-supporting framework extending in the same direction as said rolling axis and being stiffened in both said rolling axis direction and perpendicular thereto, said framework including first and second plates supported in a mutually spaced relationship on respective vertical planes lying substantially perpendicular to said axis, said first and second plates being through penetrated by respective centrally located openings sized to admit a tube blank and respective mandrel therethrough, at least one intermediate plate supported in a vertical plane substantially perpendicular to said rolling axis at a location between said first and second plates, a through opening formed centrally in said intermediate plate, said through opening being sized to admit a tube blank and respective mandrel therethrough, means for resting and securing said plates on foundation plinths, said first plate, an intermediate plate, and said second plate defining two of said adjacent seats, and rigid means for mechanically interconnecting said plates to form said self-supporting box-shape stiffened framework.

3. A continuous rolling mill according to claim 2, wherein said rigid means for mechanical interconnection includes a plurality of box-shaped longitudinal stringers oriented parallel to the rolling axis, each said longitudinal stringer being secured to said plates for mutual stiffening, and two pairs of beams bridging each said seat and being attached to respective ones of said plates at opposed locations from the openings formed therein to resist separating forces acting on said chocks during a rolling operation.

4. A continuous rolling mill according to claim 1, wherein said plurality of planar subframes are easily assembled to and disassembled from said substantially box-shaped, self-supporting framework when changing said plurality of working roll pairs.

5. A continuous rolling mill according to claim 2, wherein said plurality of planar subframes are easily assembled to and disassembled from said substantially box-shaped, self-supporting framework when changing said plurality of working roll pairs.

* * * * *